United States Patent [19]

Hamisch, Jr.

[11] 4,290,358

[45] Sep. 22, 1981

[54] PRINT HEAD

[75] Inventor: Paul H. Hamisch, Jr., Franklin, Ohio

[73] Assignee: Monarch Marking Systems, Inc., Dayton, Ohio

[21] Appl. No.: 111,442

[22] Filed: Jan. 11, 1980

[51] Int. Cl.[3] ..... B41J 1/20; B41K 1/10

[52] U.S. Cl. ..... 101/111

[58] Field of Search ..... 101/111, 110

[56] References Cited

U.S. PATENT DOCUMENTS

| | | | |
|---|---|---|---|
| 2,096,340 | 10/1937 | Richeson | 101/111 |
| 3,889,594 | 6/1975 | Nickolson | 101/111 |
| 4,010,682 | 3/1977 | Hamisch, Jr. | 101/111 |
| 4,170,938 | 10/1979 | Sato | 101/111 |
| 4,173,184 | 11/1979 | Hamisch, Jr. | 101/111 |

*Primary Examiner*—William Pieprz

*Attorney, Agent, or Firm*—Joseph J. Grass

[57] ABSTRACT

There is disclosed a print head including a one-piece support block or mounting block having a support member and a concave surface for rotatably mounting a series of drive wheels, the drive wheels being coupled to a series of printing bands which are trained about the respective wheels and the support. The support includes four abutment shoulders and each printing band is provided with a series of lugs on its underside having end faces cooperable with the abutment shoulders when the printing band is in a selected position to print a desired character.

5 Claims, 8 Drawing Figures

PRIOR ART

PRINT HEAD

BACKGROUND OF THE INVENTION

1. Field of the Invention

This invention relates to the art of print heads.

2. Brief Description of the Prior Art

Applicant's prior U.S. Pat. No. 4,173,184 granted Nov. 6, 1979, U.S. Pat. No. 3,783,083 to W. A. Jenkins, dated Jan. 1, 1974, and U.S. Pat. No. 3,783,786 to L. E. Ellison et al dated Jan. 8, 1974 are made of record.

SUMMARY OF THE INVENTION

The invention relates to an improvement of the apparatus disclosed in applicant's U.S. Pat. No. 4,173,184.

When printing characters which are designed to be machine-readable, it is essential that the printed data or characters be of the highest quality to assure that the characters can be read by the machine. According to the invention, there is provided a low-cost print head with a stationary support of integral molded plastics construction with no moving parts which provides detenting superior to that accomplished by the device according to U.S. Pat. No. 4,173,184. When advancing the printing band or prior U.S. Pat. No. 4,173,184 to bring a selected printing block to the printing position, the user is aware that the selected printing block is approaching the position at the printing zone and hence reduces the amount of turning force being applied to the selector. When the selected printing block reaches the printing zone, the leading end face contacts one of the abutment shoulders to arrest the movement of the printing band. It sometimes happens, due to the elastomeric material of which the printing band is composed and due to the fact that the lugs are quite thin so that the shoulders of each lug are very small, that the lug at the printing zone compresses slightly so that the selected printing block overtravels the desired stopping point at the printing zone just slightly.

It has been found that by providing the support with a pair of pocket-forming abutment shoulders which meet abruptly with respective supporting lands and by providing an additional pair of abutment shoulders terminating at abrupt edges for cooperating with end faces of next adjacent lugs that the detenting is outstandingly effective without increasing the thickness of the lug or the number of parts used in the support of U.S. Pat. No. 4,173,184.

According to a specific embodiment of the invention, the abutment shoulders at the pocket join the lands at a pair of abrupt edges and the support includes and additional pair of abutment shoulders terminating at an additional pair of abrupt edges. The entire or complete end face of one of the lugs abuts one abutment shoulder at the pocket and the entire or complete and end face of an adjacent lug abuts one of the additional abutment shoulders to stop the advance of the printing band when the printing band is advanced to where the selected printing block is at the printing zone. More particularly, the one abutment shoulder at the pocket contacts the root of the end face of the lug under the printing block at the printing zone and one additional abutment shoulder contacts the root of the end face of one of the lugs adjacent the pocket. Because the movement of the printing band in either direction is stopped a pair of spaced abutment shoulders, the printing band does not advance to a position where the selected printing block has over-traveled the printing position.

DESCRIPTION OF THE PREFERRED EMBODIMENTS

Figures 1, 2, 3, 4, 5, 6, 7:
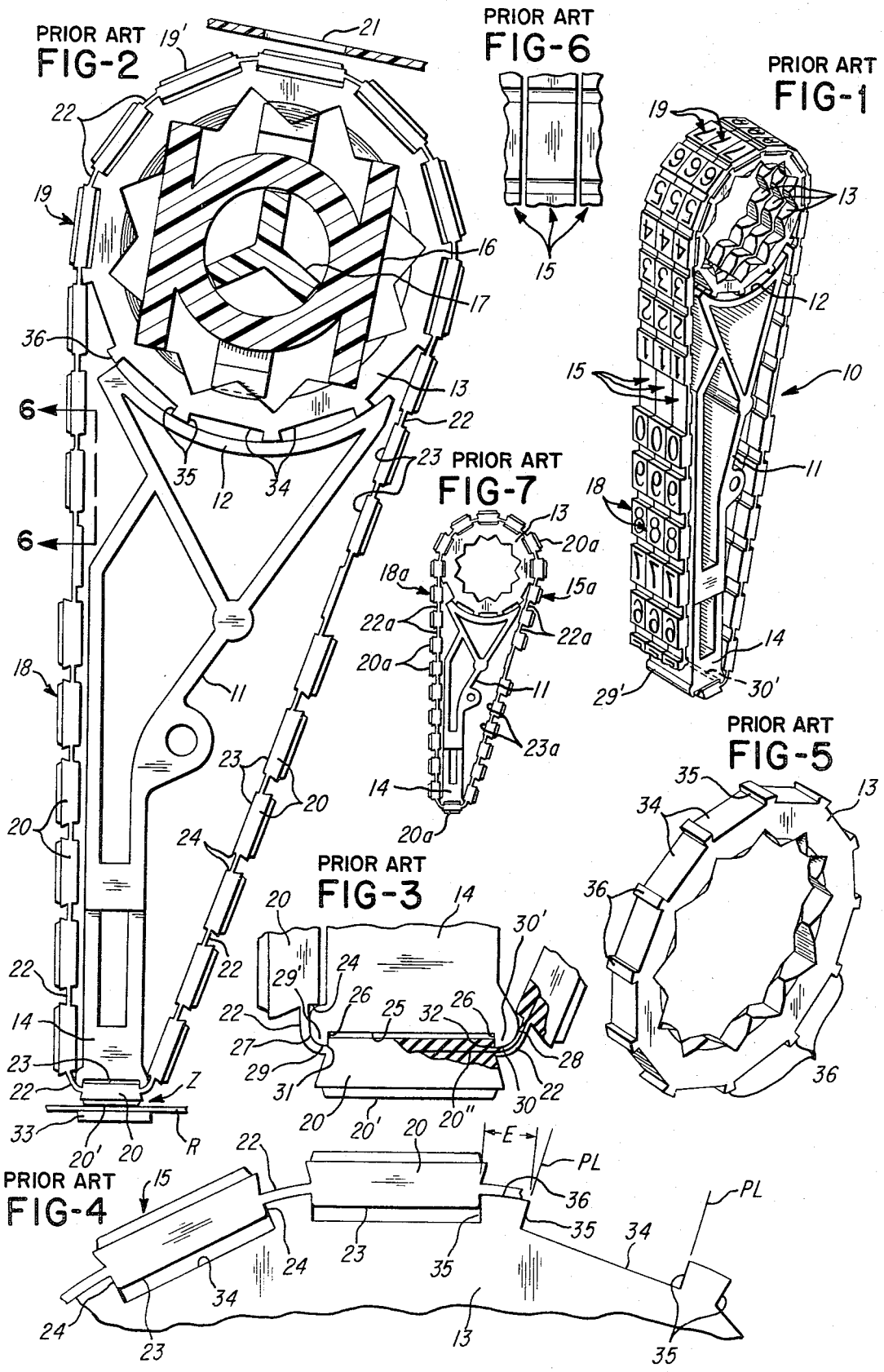
FIG-2 PRIOR ART
FIG-6 PRIOR ART
FIG-1 PRIOR ART
FIG-7 PRIOR ART
FIG-5 PRIOR ART
FIG-3 PRIOR ART
FIG. 1 is a perspective view of a fragmentary portion of a print head.
FIG. 2 is an enlarged side elevational view of the print head shown in FIG. 1.
FIG. 3 is an enlarged side elevational view showing the manner in which a printing element of a printing band is supported by a support at the printing zone.
FIG. 4 is an enlarged fragmentary view showing a portion of a drive wheel and a portion of the printing band.
FIG. 5 is a perspective view of the wheel.
FIG. 6 is a fragmentary view taken along line 6—6 of FIG. 2.
FIG. 7 is a side elevational view of an alternative embodiment.

With reference to FIG. 1, there is shown a fragmentary portion of a print head generally indicated at 10. The print head 10 includes a print head body or frame 11 having a transversely extending arcuate portion or saddle 12 in which wheels 13 are rotatably mounted. The body 11 includes a support 14. Printing bands generally indicated at 15 are trained or received about the support 14 and the respective wheels 13 so that each printing band 15 is capable of being driven by its respective drive wheel 13. A selector 16 rotatably mounted on a shaft 17 can be coupled with one wheel 13 at a time so that the wheels 13 can be selectively driven and consequently the selected printing band 15 is rotated about the support 14 the selected distance. The printing bands 15 are under slight tension. Each printing band 15 has a printing section 18 and a corresponding human readable non-printing section 19 so that when a selected printing element 20 is disposed at the printing zone Z as shown in FIG. 2, then a corresponding human readable character can be sighted through a window 21. Hinges 22 connect adjacent printing blocks or elements 20. The underside of both the printing and human readable sections 18 and 19 are provided with lugs 23. The lugs 23 preferably are generally flat and smooth on their undersides and terminate at opposed ends at generally parallel end faces 24. Each of the lugs 23 has the same length and lugs 23 are equally spaced apart. Reinforcing material such as nylon cords 20'' are shown to pass through the printing elements 20 and the hinges 22 of each individual band 15. The bands 15 are molded with elastomeric material. Each band 15 can yield resiliently as it is advanced upon rotation of wheel 13. The support 14 has a transversely extending notch or pocket 24 for receiving a lug 23 of each printing band 15 at the printing zone Z. The notch 25 has a pair of opposed shoulders 26 which are generally parallel to each other. The shoulders 26 are spaced apart by a distance approximately equal to the length of a lug 23 before the lug 23 is received in the socket 25. The lugs 23 are preferably slightly longer, for example 0.001 inch, than the distance between the shoulders 26 so that there is a slight interference fit therebetween. When a printing element 20 is at the printing zone there is one and only one location and orientation for that printing element 20 which is in effect "plugged in" by means of its respective lug 23 to the notch 25. Thus, in moving the printing band 15 to the selected position, there is no tendency whatever for the printing band to creep partly out of the pocket or notch 25 into which it snaps. As best shown in FIG. 3, the support 14 has opposed tapered entries 27 and 28 and lands 29 and 30 formed on support members 29' and 30' which terminate at the respective shoulders 26. The lands 29 and 30 support the hinges 22 at each side of the printing element 20 which is disposed at the printing zone Z. The arrangement of the support shoulders 26, the end faces 24, and the support that lands 29 and 30 provide to the hinges 22 results in excellent detenting of the printing bands 15 so that each selected printing element 20 is properly registered at the printing zone Z. The lands 29 and 30 are slightly radiussed at 31 and 32 where they join the shoulders 26. Accordingly, the printing characters 20' of the respective printing elements 20 are capable of making a quality printing impression on a record R disposed on a platen 33 when the print head 10 and the platen 33 move into cooperation with each other. With reference to FIG. 4, the wheel 13 is shown to have spaced apart notches or channels 34. Notches 34 have spaced apart shoulers 35. It is preferred that the shoulders 35 of each notch 34 be generally parallel to each other and that they be spaced apart by a distance substantially equal to the length of of the respective lugs 33. Accordingly, the end faces 24 of the printing bands 15 abut the shoulders 35 of the wheels 13 essentially squarely. In addition, peripheral extend E of arcuate lands 36 between adjacent notches 34 is approximately equal to the length of the respective hinges 22. As best shown by extension lines PL in FIG. 4, the shoulders 35 are generally parallel to each other. The lugs 23 are spaced from the bottoms of the respective notches 34. The human readable characters 19' and printing elements 20 can extend along chords of the circle defined by its wheel 13. Therefore, any printing elements 20 disposed at the wheel 13 cannot acquire a predetermined curvature. The flexure in the band 15 takes place at the hinges 22. The hinges 22 are relatively thin as compared with the combined thickness of the printing element 20 and its associated lug 23.

The embodiment of FIG. 7 is identical to the embodiment of FIGS. 1 through 6, except that the band **15*a* has only a printing section 18*a* but no human readable section. The printing section 18*a* extends for substantially the entire length of the band 15*a*. It is apparent that because of the configuration of the wheel 13, all the bending takes place in hinges 22*a*. Hence the printing elements 20*a* disposed at the wheel cannot acquire a predetermined curvature. The hinges 22*a* are also relatively thin as compared with the combined thickness of a printing element 20*a* and its associated lug 23*a***.

In the above embodiments, the lugs 23 and **23*a* are about 0.145 inch in length, and the lugs 23 and 23*a* are about 0.01 inch thick measured from the undersides of the hinges and preferably less than about 0.02 inch thick. Lugs 23 and 23*a*** are spaced apart about 0.062 inch.

Further details of the selector 16 and wheels 13 are disclosed in above mentioned U.S. Pat. No. 3,783,083.

Figure 8:
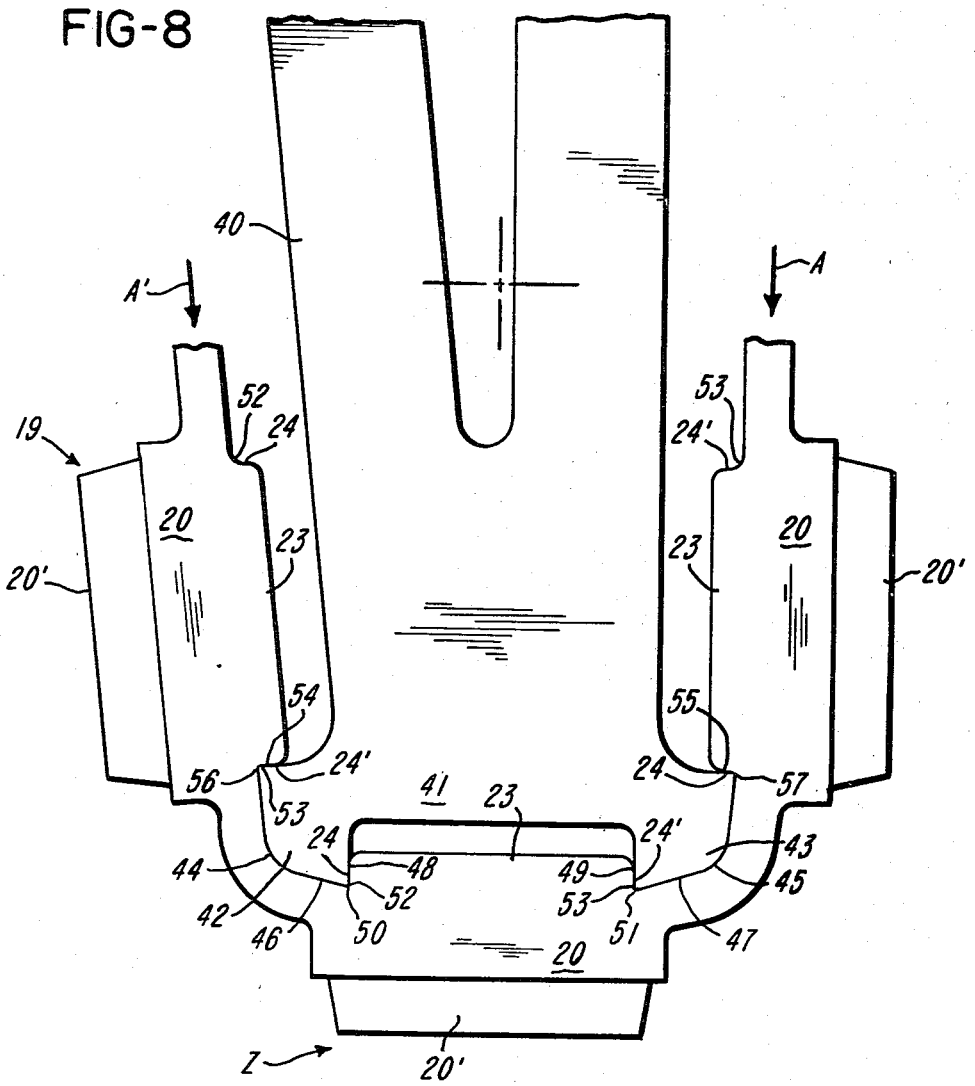
FIG. 8 is a view similar to FIG. 3, showing applicant's invention.

With reference to FIG. 8, there is shown a fragmentary portion of a print head body or frame 40, and the fragmentary portion of a printing band generally indicated at 19. Except for support 41, the embodiment of FIG. 8 is identical to the embodiment of FIGS. 1 through 6. The support 41 includes a pair of support members 42 and 43. The support members 42 and 43 have tapered entries 44 and 45 which terminate at supporting lands 46 and 47. The support 41 has a pair of abutment shoulders 48 and 49 which join the respective lands 46 and 47 at abrupt edges 50 and 51. The lug 23 has a pair of end faces 24 and 24' which join the underside of the printing block at respective roots 52 and 53. The support 41 also has an additional pair of abutment shoulders 54 and 55. The abutment shoulder 54 is shown to be in complete contact with the end face 24' of a respective lug 23 and the shoulder 55 is shown to be in complete contact with the end face 24 of another lug 23. More particularly, the shoulders 54 and 55 join the tapered entries at abrupt edges 56 and 57. The abrupt edges 56 and 57 are shown to contact the roots 52 and 53.

When the selector 16 is rotated to advance a respective wheel 13, the printing band 19 can be advanced in the direction according to arrow A. When the selected printing block 20 has reached the printing position or printing zone Z, and the user lessens the advancing force applied to the selector 16, the end face 24 contacts the abutment shoulder 48 and simultaneously therewith the end face 24 of an adjacent lug 23 contacts the abutment shoulder 55, thereby stopping the motion of the printing band 19 with the selected printing block 20 registered precisely with the printing zone Z. In this position, the other abutment shoulders 49 and 54 are also in contact with end faces 24' of the respective lugs 23.

In the event the printing band 19 is advanced in the direction of arrow A' to bring a selected printing block 20 to a printing position, the end faces 24' will abut respective abutment shoulders 49 and 54 to arrest the movement of the printing band 19, thereby bringing the selected printing block 20 precisely to the printing position in precise detented relationship with respect to the support 41 and the other printing blocks 20 of the other printing members 19.

As seen in FIG. 8, the roots 52 and 53 are slightly radiussed, when not engaged by an abrupt edge. However, the abrupt edges 50, 57 and 51,56 compress the elastomeric material at the respective roots 52 and 53 as shown. Optimally, the abrupt edges 50, 51, 56 and 57 are not radiussed.

Other embodiments and modifications of this invention will suggest themselves to those skilled in the art, and all such of these as come within the spirit of this invention are included within its scope as best defined by the appended claims.

I claim:

1. In a print head comprising a stationary support, the support including a pair of spaced support members having respective lands and tapered entries joined to the lands, the support members having abutment shoulders joining the lands and defining a pocket for receiving a lug, a series of rotatably mounted wheels, a series of printing bands trained about the wheels and the support, means selectively engageable with any printing band for advancing the respective printing band in either direction, each printing band having a plurality of printing blocks, the printing blocks of each band having a plurality of different printing elements, hinges joining the printing blocks, a lug at the underside of each printing block, each lug having a pair of spaced end faces, the end faces being joined at their roots to the undersides of the respective printing blocks, and each lug being selectably received and detented in the pocket with its respective end faces in abutment with the abutment shoulders, the improvement in the detenting comprising that the abutment shoulders join the lands at a pair of abrupt edges, the support having an additional pair of abutment shoulders terminating at an additional pair of abrupt edges so that advance of the printing band in one direction is stopped by one abutment shoulder and one additional abutment shoulder contacting the roots of end faces of adjacent lugs or advance of the printing band in the opposite direction is stopped by the other abutment shoulder and the other additional abutment shoulder contacting the roots of end faces of adjacent lugs.

2. In a print head comprising a stationary support, the support including a pair of spaced support members having respective lands and tapered entries joined to the lands, the support members having abutment shoulders joining the lands and defining a pocket for receiving a lug, a series of rotatably mounted wheels, a series of printing bands trained about the wheels and the support, means selectively engageable with any printing band for advancing the respective printing band in either direction, each printing band having a plurality of printing blocks, the printing blocks of each band having a plurality of different printing elements, hinges joining the printing blocks, a lug at the underside of each printing block, each lug having a pair of spaced end faces, the end face being joined at their roots to the underside of the respective printing blocks, and each lug being selectably received and detented in the pocket with its respective end faces in abutment with the abutment shoulders, the improvement in the detenting comprising that the abutment shoulders join the lands at a pair of abrupt edges, the support having an additional pair of abutment shoulders terminating at an additional pair of abrupt edges so that advance of the printing band in one direction is stopped by one abutment shoulder and one additional abutment shoulder contacting the roots of end faces of adjacent lugs or advance of the printing band in the opposite direction is stopped by the other abutment shoulder and the other additional abutment shoulder contacting the roots of end faces of adjacent lugs, wherein the abutment shoulders defining the pocket are generally parallel, and wherein the additional abutment shoulders lie in a flat plane generally perpendicular to the abutment shoulders.

3. In a print head comprising a stationary support, the support including a pair of spaced support members having respective lands and tapered entries joined to the lands, the support members having abutment shoulders joining the lands and defining a pocket for receiving a lug, a series of rotatably mounted wheels, a series of printing bands trained about the wheels and the support, means selectively engageable with any printing band for advancing the respective printing band in either direction, each printing band having a plurality of printing blocks, the printing blocks of each band having a plurality of different printing elements, hinges joining the printing blocks, a lug at the underside of each printing block, each lug having a pair of spaced end faces, the end faces being joined at their roots to the undersides of the respective printing blocks, and each lug being selectably received and detented in the pocket with its respective end faces in abutment with the abutment shoulders, the improvement in the detenting comprising that the abutment shoulders join the lands at a pair of abrupt edges, the support having an additional pair of abutment shoulders terminating at an additional pair of abrupt edges so that advance of the printing band in one direction is stopped by one abutment shoulder and on additional abutment shoulder contacting the roots of end faces of adjacent lugs or advance of the printing band in the opposite direction is stopped by the other abutment shoulder and the other additional abutment shoulder contacting the roots of end faces of adjacent lugs, wherein the additional shoulders lie in a flat plane.

4. In a print head comprising a stationary support, the support including a pair of spaced support members having respective lands and tapered entries joined to the lands, the support members having abutment shoulders joining the lands and defining a pocket for receiving a lug, a series of rotatably mounted wheels, a series or printing bands trained about the wheels and the support, means selectively engageable with any printing band for advancing the respective printing band in either direction, each printing band having a plurality of printing blocks, the printing blocks of each band having a plurality of different printing elements, hinges joining the printing blocks, a lug at the underside of each printing block, each lug having a pair of spaced end faces, the end faces being joined at their roots to the undersides of the respective printing blocks, and each lug being selectably received and detented in the pocket with its respective end faces in abutment with the abutment shoulders, the improvement in the detenting comprising that the abutment shoulders join the lands at a pair of abrupt edges, the support having an additional pair of abutment shoulders terminating at an additional pair of abrupt edges so that advance of the printing band in one direction is stopped by one abutment shoulder and one additional abutment shoulder contacting the roots of end faces of adjacent lugs or advance of the printing band in the opposite direction is stopped by the other abutment shoulder and the other additional abutment shoulder contacting the roots of end faces of adjacent lugs, wherein the abrupt edges are molded as an integral part of the support.

5. In a print head comprising a stationary support, the support including a pair of spaced support members having respective lands and tapered entries joined to the lands, the support members having abutment shoulders joining the lands and defining a pocket for receiving a lug, a series of rotatably mounted wheels, a series of printing bands trained about the wheels and the support, means selectively engageable with any printing band for advancing the respective printing band in either direction, each printing band having a plurality of printing blocks, the printing blocks of each band having a plurality of different printing elements, hinges joining the printing blocks, a lug at the underside of each printing block, each lug having a pair of spaced end faces, the end faces joining the underside of the respective printing blocks, and each lug being selectably received and detented in the pocket with its respective end faces in abutment with the abutment shoulders, the improvement in the detenting comprising that the abutment shoulders join the lands at a pair of abrupt edges, the support having an additional pair of abutment shoulders terminating at an additional pair of abrupt edges so that advance of the printing band in one direction is stopped by one abutment shoulder and one additional abutment shoulder contacting the complete end faces of adjacent lugs or advance of the printing band in the opposite direction is stopped by the other abutment shoulder and the other additional abutment shoulder contacting the complete end faces of adjacent lugs.

* * * * *

UNITED STATES PATENT AND TRADEMARK OFFICE

CERTIFICATE OF CORRECTION

PATENT NO. : 4,290,358

DATED : September 22, 1981

INVENTOR(S) : Paul H. Hamisch, Jr.

It is certified that error appears in the above-identified patent and that said Letters Patent are hereby corrected as shown below:

Column 1, line 16, "of" should be --to--; line 53, "and" (second occurrence) should be --an--; line 57, "and" (second occurrence) should be omitted; line 67, after "stopped" --by-- has been omitted. Column 2, line 59, "24" should be --25--. Column 3, line 31, "extend" should be --extent--. Column 5, line 28, "face" should be --faces--. Column 6, line 1, "on" should be --one--.

Signed and Sealed this

*Twenty-second* Day of *December 1981*

[SEAL]

*Attest:*

GERALD J. MOSSINGHOFF

*Attesting Officer*

*Commissioner of Patents and Trademarks*